US008978173B1

(12) United States Patent
Lederer et al.

(10) Patent No.: US 8,978,173 B1
(45) Date of Patent: Mar. 17, 2015

(54) PORTABLE TOILET

(71) Applicants: Eugene G Lederer, Los Angeles, CA (US); Federico E Vierheller, Fullerton, CA (US)

(72) Inventors: Eugene G Lederer, Los Angeles, CA (US); Federico E Vierheller, Fullerton, CA (US)

(73) Assignee: Eugene G. Lederer, Los Angeles, CA (US)

( * ) Notice: Subject to any disclaimer, the term of this patent is extended or adjusted under 35 U.S.C. 154(b) by 0 days.

(21) Appl. No.: 14/201,789

(22) Filed: Mar. 7, 2014

Related U.S. Application Data

(63) Continuation of application No. 14/154,135, filed on Jan. 13, 2014, which is a continuation of application No. 13/663,413, filed on Oct. 29, 2012, now Pat. No. 8,627,518.

(51) Int. Cl.
*E03D 11/00* (2006.01)
*A47K 11/04* (2006.01)

(52) U.S. Cl.
CPC ..... *A47K 11/04* (2013.01)
USPC ..... 4/434; 4/445; 4/667

(58) Field of Classification Search
USPC ..... 4/420.3, 434, 438, 441, 442, 445, 471, 4/665, 667
See application file for complete search history.

(56) References Cited

U.S. PATENT DOCUMENTS

| | | | |
|---|---|---|---|
| 888,643 | A | 5/1908 | Naviokus |
| 3,457,567 | A | 7/1969 | Criss |
| 4,031,575 | A | 6/1977 | Landsberger |
| 5,852,832 | A | 12/1998 | Voigt et al. |
| 6,000,068 | A | 12/1999 | Chavis |
| 6,006,369 | A | 12/1999 | Bly |
| 6,263,521 | B1 | 7/2001 | Pi |
| 6,341,386 | B1 | 1/2002 | Phillips et al. |
| 6,782,565 | B2 | 8/2004 | Hinton |

*Primary Examiner* — Tuan N Nguyen
(74) *Attorney, Agent, or Firm* — Mark W Handley; Handley Law Firm, PLLC

(57) ABSTRACT

A portable toilet has a bowl, a seat, and legs. The legs are telescopically extensible to allow positioning of the height of the bowl and wheels are mounted to the lower ends of the legs. The legs are spaced apart for fitting on opposite sides of a conventional building toilet and placing the bowl above the conventional toilet. The bowl has an open lower end which is enclosed by a slide door which is moved to open the lower end of the bowl and allow the contents of the bowl to spill therefrom into the conventional toilet. The contents of the bowl fall through the open lower end of the bowl and into the conventional building toilet. Preferably, pneumatic spring assist or an electric linear actuator are provided to aid in lifting and lowering the bowl after use. Water is provided for sweeping waste from within the bowl.

18 Claims, 10 Drawing Sheets

PORTABLE TOILET

CROSS-REFERENCE TO RELATED APPLICATION

The present application claims priority as a continuation-in-part of U.S. patent application Ser. No. 14/154,135, filed 13 Jan. 2014, which is a continuation of U.S. Pat. No. 8,627,518, having application Ser. No. 13/663,413 and filed 19 Oct. 2012, each invented by Eugene G. Lederer, an inventor of the present application, and Ralph E. White.

TECHNICAL FIELD OF THE INVENTION

The present invention relates in general to portable toilets, and in particular to a portable toilet for bedside use which provides for easy cleaning by care givers.

BACKGROUND OF THE INVENTION

Prior art portable toilets which have been provided for bedside use are typically cleaned by an attendant or care giver, usually requiring the emptying of pans or bowls. In hospitals a portable toilet has been provided by a bench having a hole in the seat for receipt of a bowl used for receiving waste. After use, the bowl must be removed, emptied, and then cleaned by the attendant or care giver. Portable toilets have also been provided by chairs or stools having a hole in the seat for receiving a receptacle bag which is disposed of after use, requiring the attendant or the care giver to remove the bag for disposal. An alternative is desired which reduces the need for an attendant or a care giver to handle waste for disposal.

SUMMARY OF THE INVENTION

A portable toilet is provided having a bowl, a seat, and legs. The seat is pivotally mounted to the bowl. The legs are telescopically extensible to allow positioning of the height of the bowl and wheels are mounted to the lower ends of the legs. The legs are spaced apart for fitting on opposite sides of a conventional building toilet and placing the bowl above the conventional toilet. The bowl has an open lower end which is enclosed by a slide door which is moved to open the lower end of the bowl and allow the contents of the bowl to spill therefrom into the conventional toilet. After use, the portable toilet is positioned above the conventional building toilet, the slide door is moved to open the lower end of the bowl, and the contents of the bowlfall through the open lower end of the bowl and into the conventional building toilet. Preferably, pneumatic spring assist or an electric linear actuator are provided to aid in lifting and lowering the bowl after use. A tube and faucet connector are provided for connecting to a sink water faucet and passing water through spray nozzles mounted in the bowl.

DESCRIPTION OF THE DRAWINGS

For a more complete understanding of the present invention and the advantages thereof, reference is now made to the following description taken in conjunction with the accompanying Drawings in which

FIG. 1 is a perspective views of the portable toilet with the seat in a downward position and the lid in an upward position;

FIG. 2 is a perspective view of the portable toilet from an opposite direction from FIG. 1;

FIG. 3 is a perspective view of a pneumatic spring system for use in assisting lifting of the portable toilet;

FIG. 4 is an exploded view of the portable toilet;

FIG. 5 is an exploded view of the enclosure and the toilet bowl;

FIGS. 6 and 7 are longitudinal vertical section views of the enclosure and the toilet bowl;

FIG. 8 is a perspective view of a faucet coupling;

FIG. 9 is a perspective view of a cable splitter;

FIG. 10 is a perspective views of an alternative portable toilet have legs which are telescopically adjustable by means of electric linear actuators;

FIG. 11 is a perspective view of an electric lift system for use in telescopically extending and retracting the legs;

DETAILED DESCRIPTION OF THE INVENTION

Figure 1:
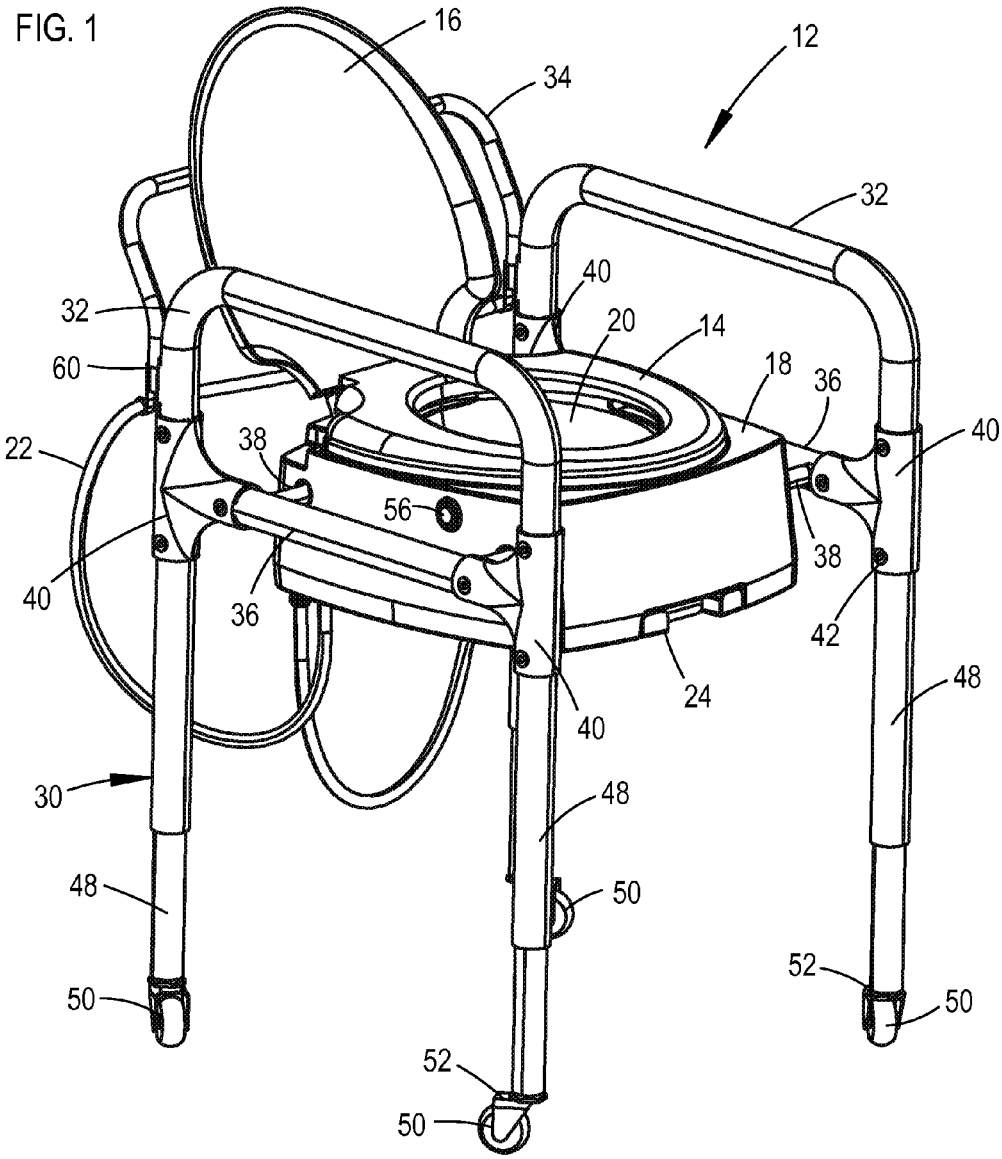
FIGS. 1 through 11 show various aspects for a portable toilet made according to the present invention, as set forth below.
Figure 2:
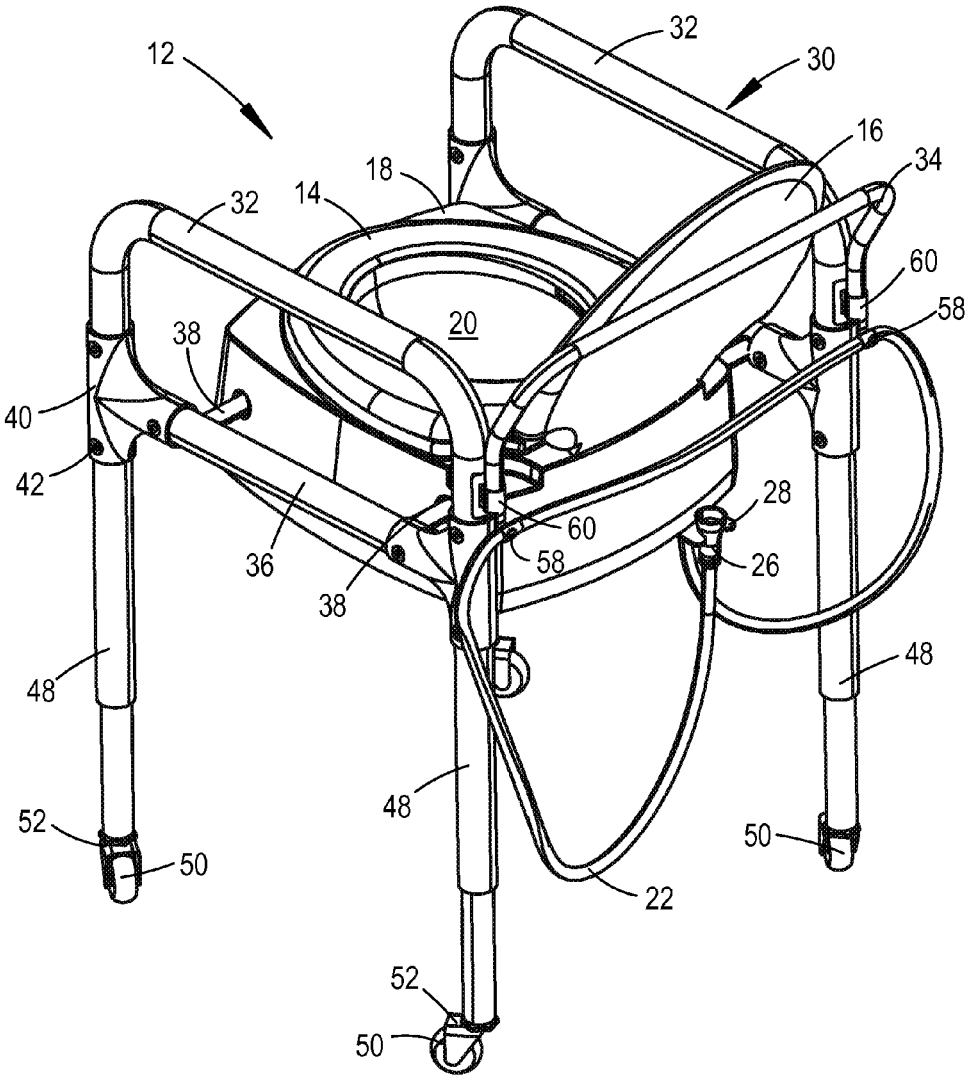

FIGS. 1 and 2 are perspective views of a portable toilet 12 viewed from opposite directions. The portable toilet 12 has a seat 14 and a lid 16 which are pivotally mounted to an enclosure 18. A toilet bowl 20 is mounted within the enclosure 18. Water supply tubing 22 and a faucet coupling 26 are provided for securing to a building water faucet to supply water to the portable toilet 12 for automatically cleaning the toilet bowl. The bowl 20 has an open lower end which is enclosed by a slide door 24. The slide door 24 is selectively opened by an operator for dumping the contents of the portable toilet 12 into a conventional building toilet. A mounting bracket 28 is provided for securing the faucet coupling 26 to the enclosure 18 for storage. Hose retainer clips 58 are also proved for securing the water supply tubing 22 to the enclosure 18. A back rest clip 60 is also provided for securing the back rest 34 to the frame 30.

The portable toilet 12 also has a frame 30 which includes two arm rests 32, a back rest 34, cross bars 36, and support arms 38. Mounting brackets 40 are secured by fasteners 42 to the enclosure 18. The fasteners 42 may have sleeves or pulleys mounted thereto and disposed interiorly within the mounting brackets 40 for reducing the frictional forces when pulling actuation cables. Four legs 48 are provided for supporting the portable toilet 12. Wheels 50 are secured to the lower ends of the legs 48. Preferably, at least the two front legs have wheel locks 52. Preferably pneumatic cylinders 62 (See FIG. 3) are coaxially disposed within the legs 48 for providing spring members to assist in raising and lowering the legs 48. A leg actuation button 56 is provided on one side of the enclosure 18 for releasing the pneumatic cylinders to provide spring assist.

The legs 48 have upper portions fixedly secured to the enclosure 18 and lower portions which telescopically extend beneath the upper portions. Cross-bars 36 extend between the lower portions of the legs 48. Wheels 50 are provided on the lower portions of the legs 48, and preferably are provided by castor wheels having stops 52 which are selectively operated to prevent the wheels 50 from rotating when the portable toilet 12 is disposed in a selected position. The legs 58 are preferably spaced apart at least either from side-to-side, or from front-to-front, to fit a conventional building toilet therebetween, such as set forth in U.S. Pat. No. 8,627,518, entitled "Portable Toilet," invented by Eugene G. Lederer and Ralph E. White, having application Ser. No. 13,663,413, filed on 29

Oct. 2012, and issued on Jan. 14, 2014. U.S. Pat. No. 8,627,518 is hereby incorporated by reference as if fully set forth herein.

Figure 3:
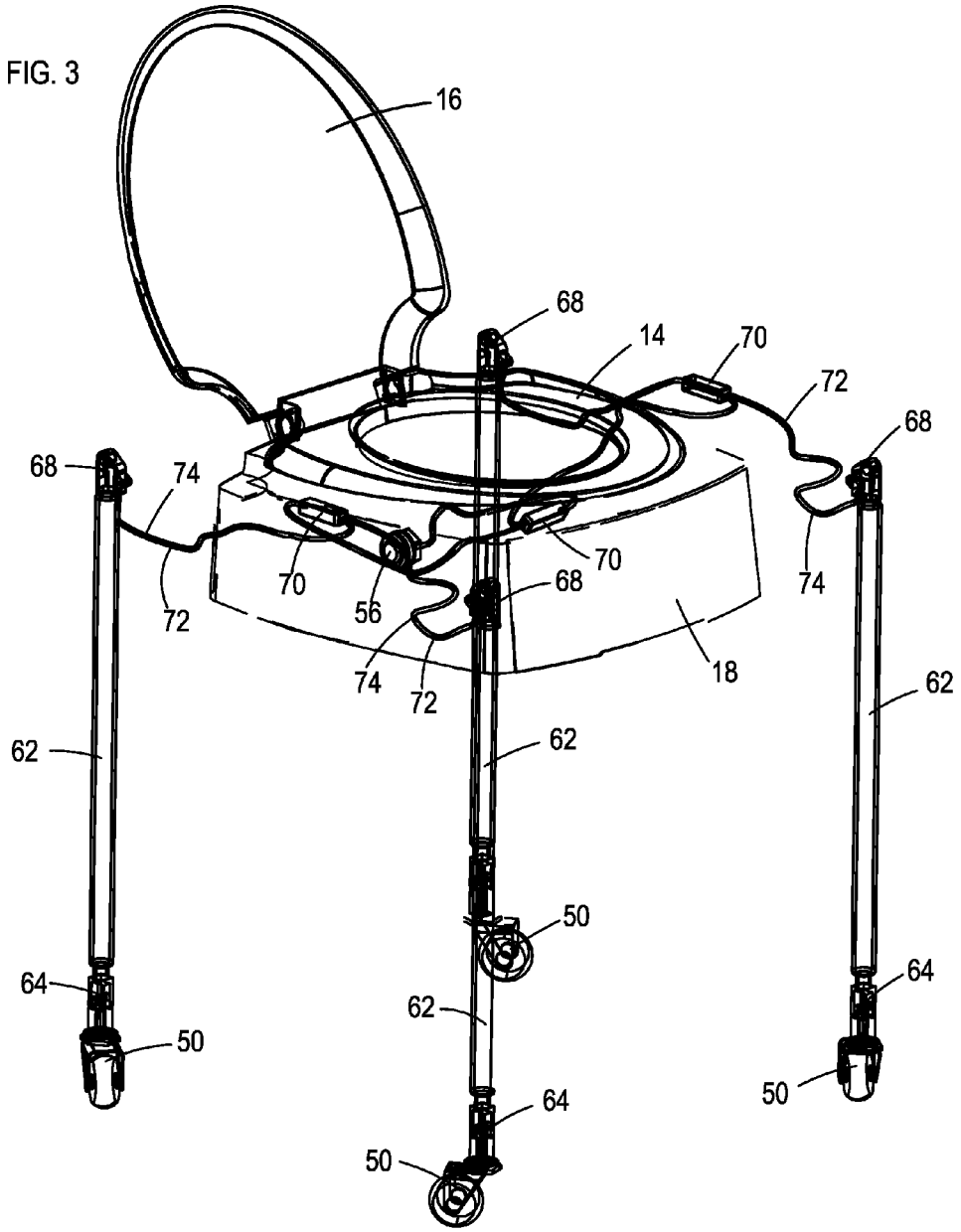

FIG. 3 is a perspective view of a pneumatic spring system 76 for use in assisting lifting of the portable toilet 12 for dumping the contents of the bowl into a conventional building toiler. The pneumatic springs 62 are enclosed within the legs 48. An upper end of the springs 62 has an actuator 68 for releasing the pneumatic springs 62 to telescopically extend and retract. The leg actuation button 56 is connected to each of the actuators 68, such that a short push of the button 56 will move each of the actuators 68, releasing the pneumatic cylinders 62 to telescopically extend. Three cable spillers 70 are provided for connecting between the actuation button 56 and each of the actuators 68. Tubing 72 extends outward of the cable splitters, and conductive cables 74 are located within the tubing.

Figure 4:
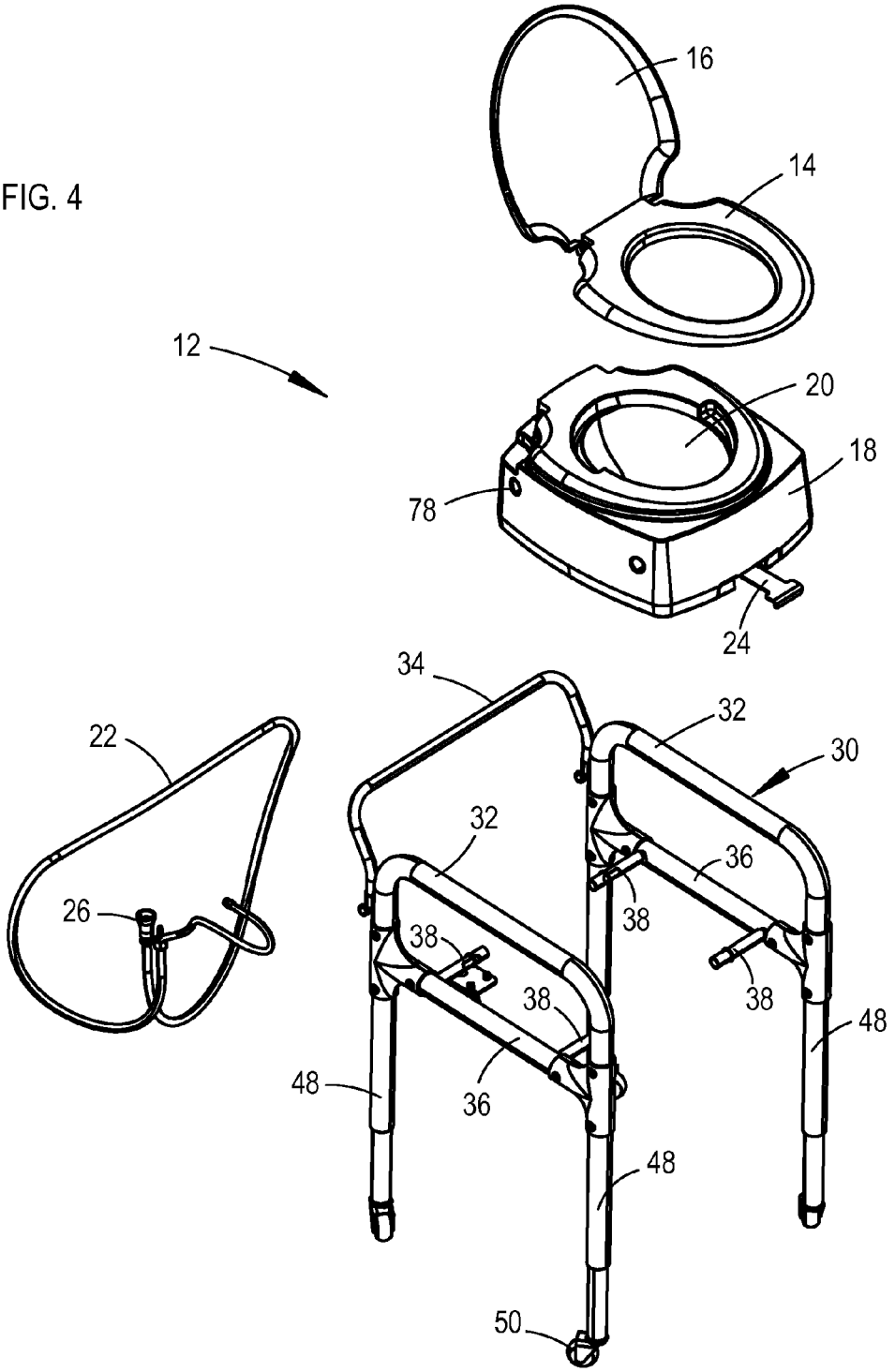

FIG. 4 is an exploded view of the portable toilet 12. The frame 30 is shown beneath the enclosure 18. The water supply tubing 22 is shown to the left of the frame 30. The enclosure 18 is shown with the slide door 24 disposed in an outward position, such that the contents of the bowl 20 are passing form the bowl 20 into a waste receptacle, such as a conventional building toilet.

Figure 5:
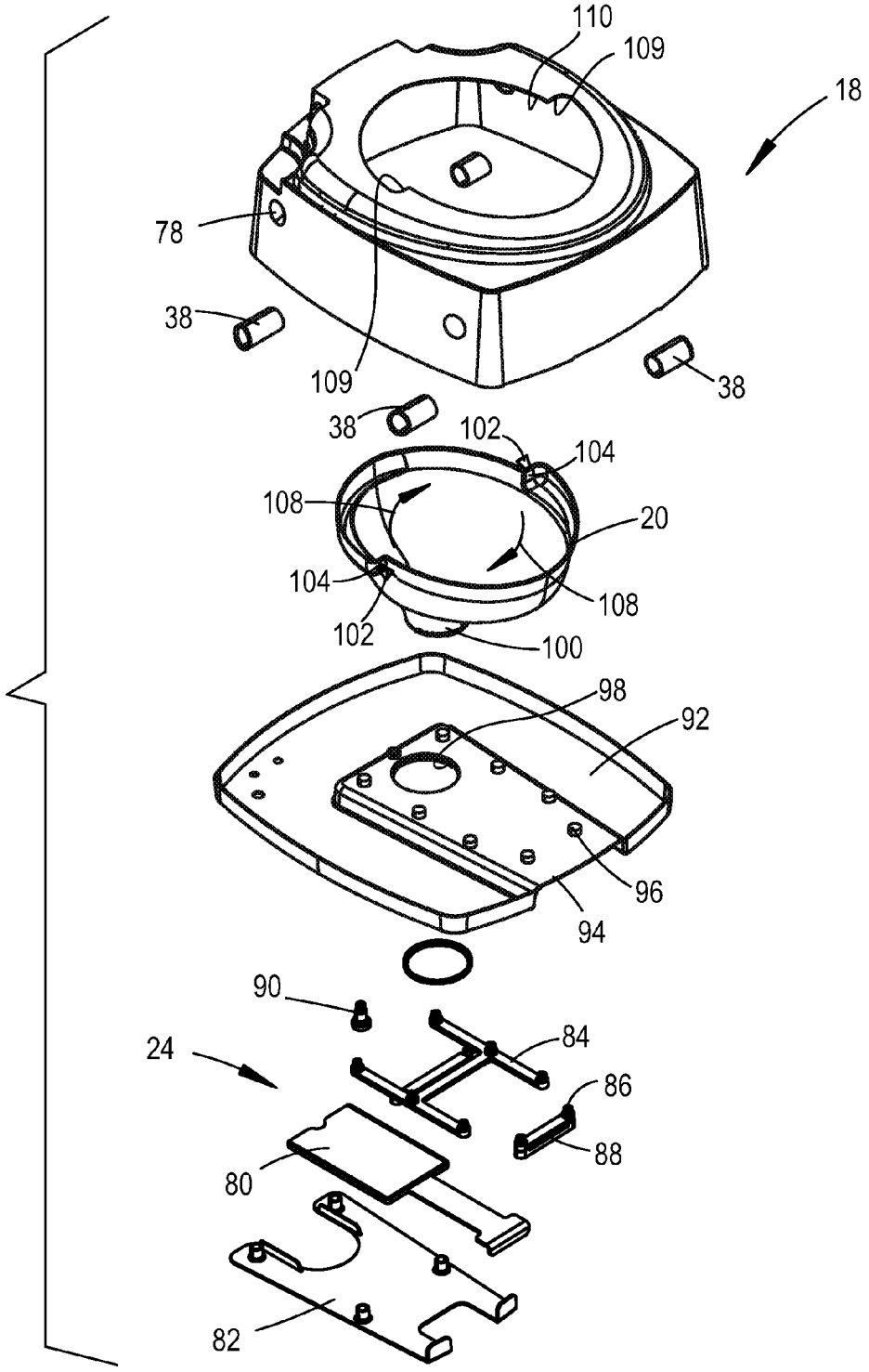

FIG. 5 is an exploded view of the slide door 24, the enclosure 18, and the toilet bowl 12. The slide door 24 has a mounting bracket 82, guide members 84, 86 and 88, and a stop screw 90. A slide plate 80 provides a moveable valve member which is disposed between the mounting bracket 82, and guide members 84, 86 and 88. A recess 94 is defined by a groove for receiving the assembly for the slide door 24. Bosses 96 are also formed to provide a means for securing threaded fasteners. A hole 98 is provided in the bottom plate 92 for receiving the lower end of the toilet bowl 20. The bowl 20 has two flats 104 disposed adjacent to the rim. Spray nozzles 102 are mounted in the flats 104 and are directly connected to the water supply tubing 22. The spray nozzles 102 preferably create a swirl in the direction of the arrow 108. The enclosure 18 as a hole profile 110 with flats 109 for mating with the flats 104, preventing rotation of the toilet bow 20 within the enclosure 18.

Figure 6:
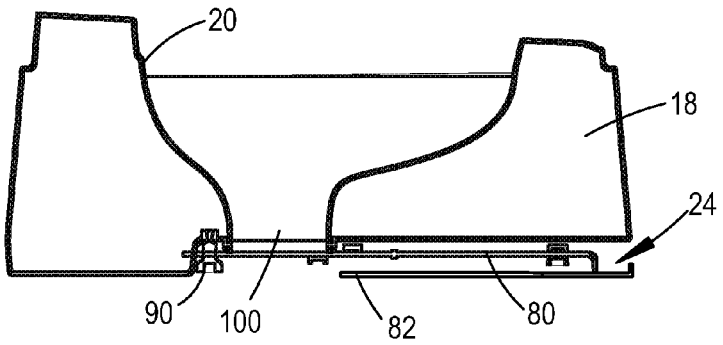
Figure 7:
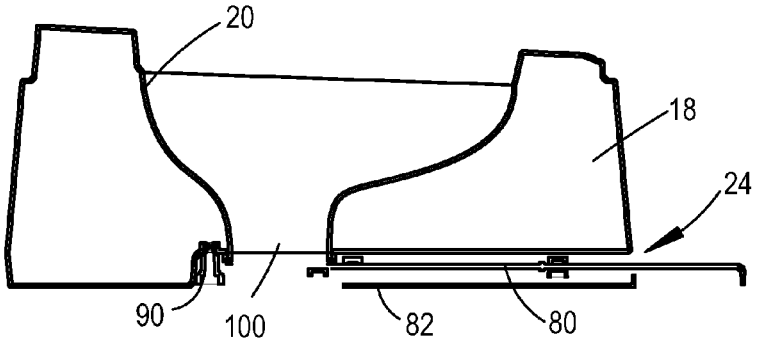

FIGS. 6 and 7 are partial longitudinal vertical section views of the enclosure 18 and the toilet bowl 20, and show operation of the slide door 24.

Figure 8:
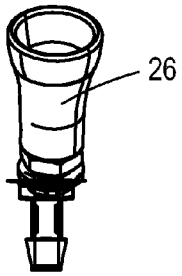

FIG. 8 is a perspective view of a faucet coupling 26 for securing to a conventional household faucet to supply water. The faucet coupling is preferably formed of a compliant, elastomeric material.

Figure 9:
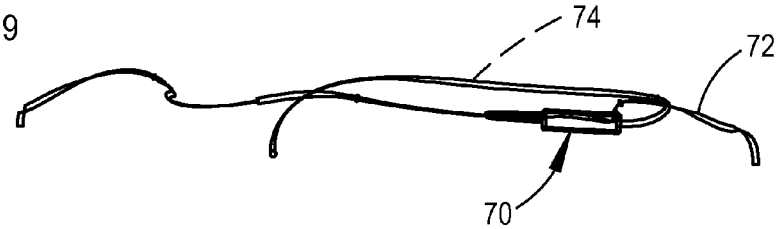

FIG. 9 is a perspective view of a cable splitter.

Figure 10:
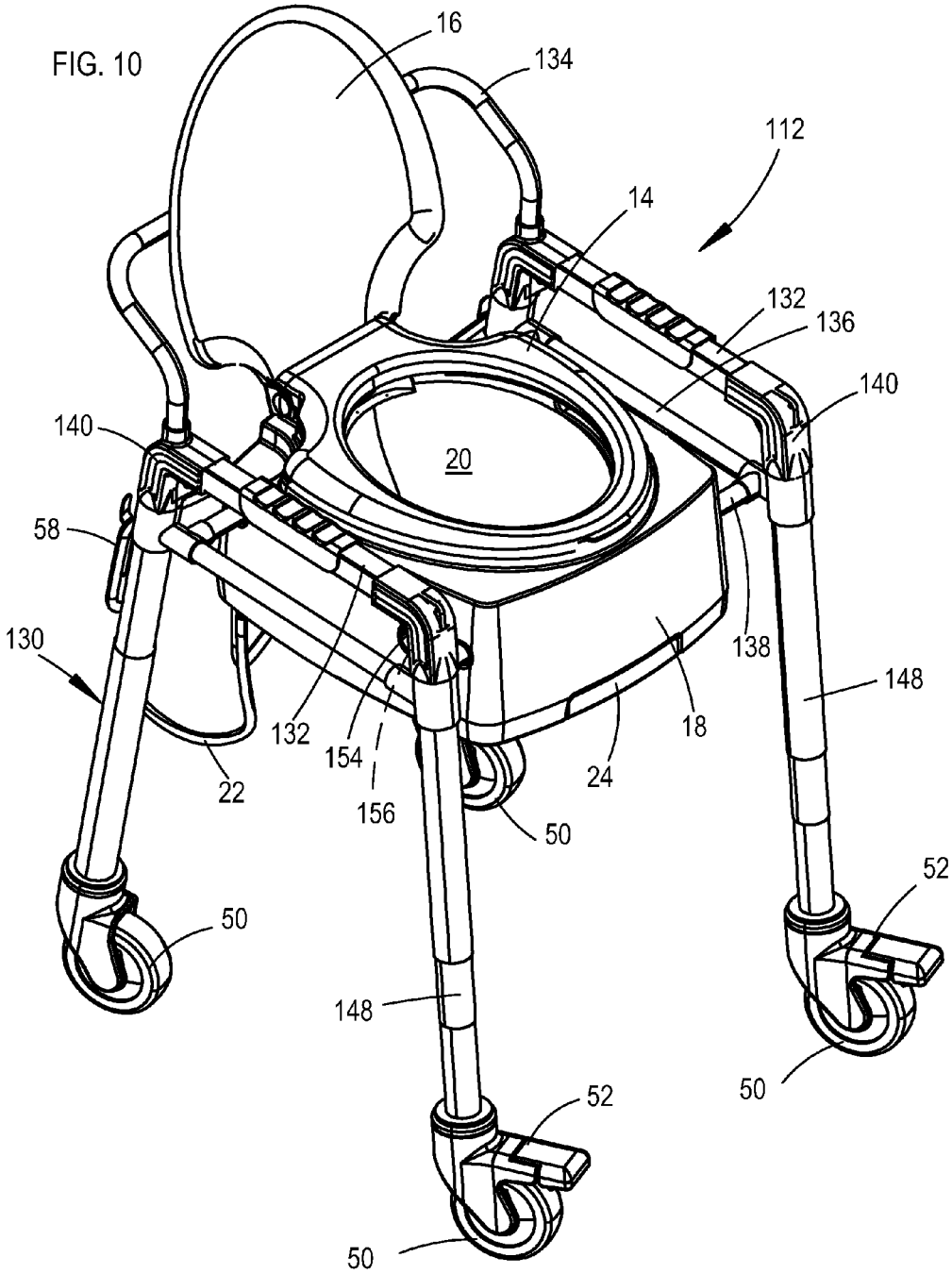

FIG. 10 is a perspective views of an alternative portable toilet 112 having legs 148 which are telescopically adjustable by means of electric linear actuators 162. The portable toilet 112 has the seat 14 and the lid 16 which are pivotally mounted to the enclosure 18. The enclosure 18 and the toilet bowl is used in the portable toilet 112, along with the water supply tubing 22 and the faucet coupling 26. The bowl 20 has the open lower end which is enclosed by the slide door 24. Preferably the slide door 24 is electronically operated. The slide door 24 is selectively opened by an operator for dumping the contents of the portable toilet 12 into a conventional building toilet. The hose retainer clips 58 are also proved for securing the water supply tubing 22 to the enclosure 18. The back rest 134 fits directly in mounting brackets for a chair frame 130.

The portable toilet 12 also has a frame 130 which includes two arm rests 132, the back rest 134, cross bars 136, and support arms 138. Mounting brackets 140 are fixedly secured the frame 130, preferably by means of an adhesive or sonic welding. Four legs 148 are provided for supporting the portable toilet 112. Wheels 50 are secured to the lower ends of the legs 148. Preferably, at least the two front legs have wheel locks 52. Preferably electric linear actuators 162 (See FIG. 3) are coaxially disposed within the legs 148 for providing spring members to assist in raising and lowering the legs 148. A leg actuation buttons 154 and 156 are provided on one side of the enclosure 18 for operating the electric linear actuators 162, to extend and retract the legs 162. The legs 148 have upper portions fixedly secured to the enclosure 18 and lower portions which telescopically extend beneath the upper portions. Cross-bars 136 extend between the lower portions of the legs 148. Wheels 50 are provided on the lower portions of the legs 48, and preferably are provided by castor wheels having stops 52 which are selectively operated to prevent the wheels 50 from rotating when the portable toilet 12 is disposed in a selected position. The legs 58 are preferably spaced apart at least either from side-to-side, or from front-to-front, to fit a conventional building toilet there-between, such as set forth in U.S. Pat. No. 8,627,518 as noted above.

Figure 11:
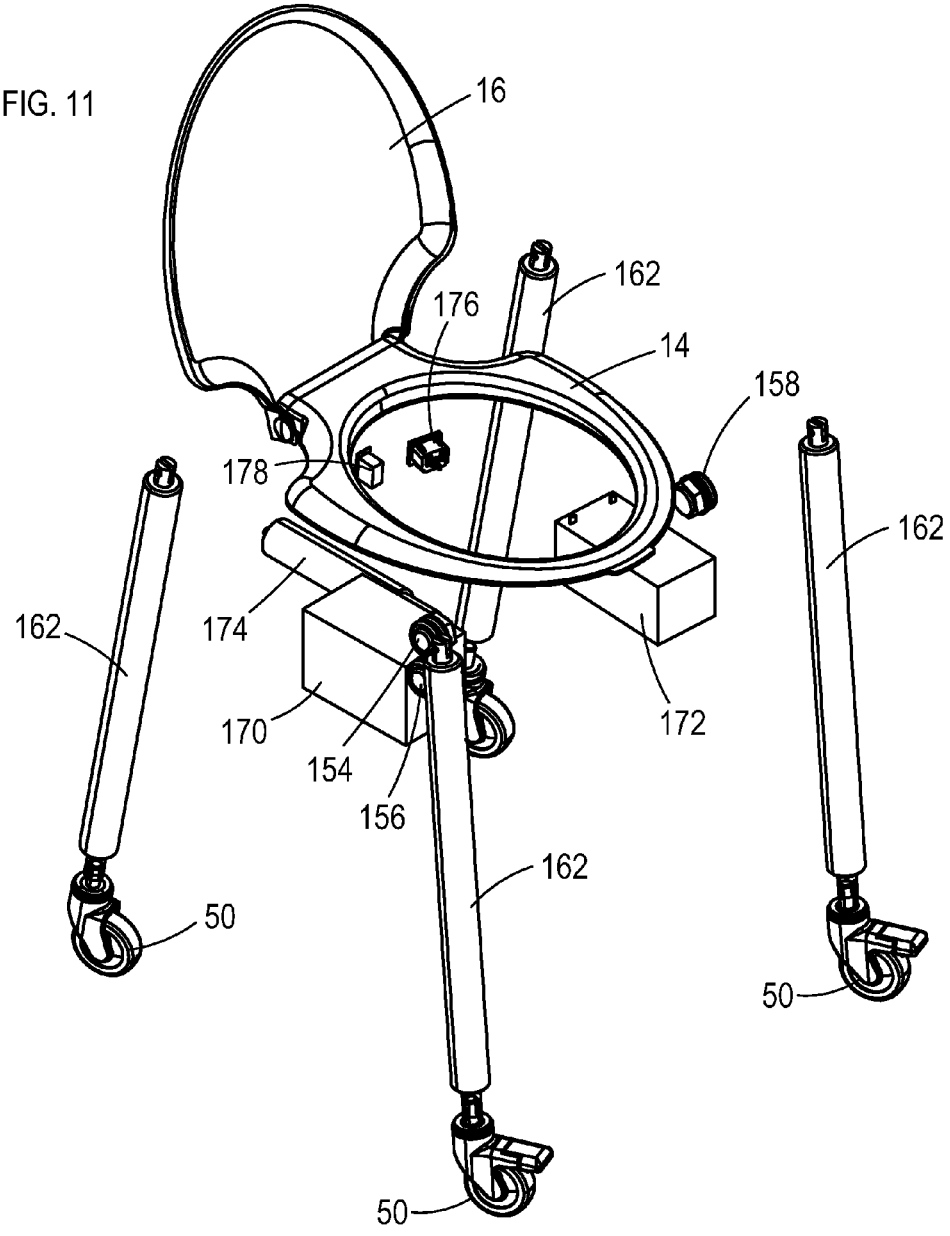

FIG. 11 is a perspective view of an electric lift system for use in telescopically extending and retracting the legs 148. Electric linear actuators 162 are concentrically disposed with respective ones of the legs 148 and are moved upward in response an operator pressing the button 154. Downward movement occurs in response to pressing the button 156. A button 158 is provided for operating an electric linear actuator 174 to open the slide door 24. Preferably the actuator 174 is spring biased to return automatically to a non-actuated position. A battery 170 and a batter charger 172 are provided for powering the linear actuators 162 and 174. A power connector 176 is preferably provided by a standard, household three prong power connector. An on-off power switch 178 is also provided.

Figure 12:
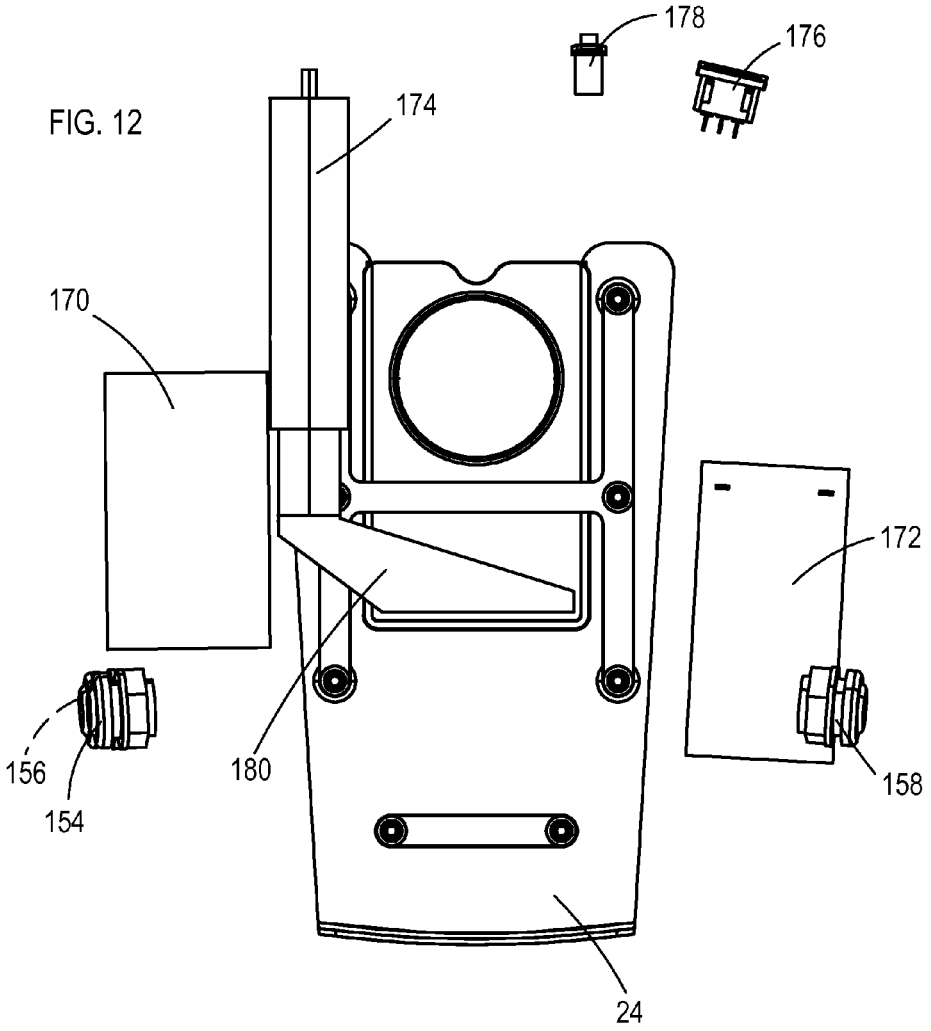
FIG. 12 is a top view of an electric linear actuator for opening and closing the slide door.

FIG. 12 is a top view of a electric linear actuator 174 for opening and closing the slide door 24. An actuator arm 180 is mounted to extend from the moveable valve element provided by the slide plate 80.

Figure 13:
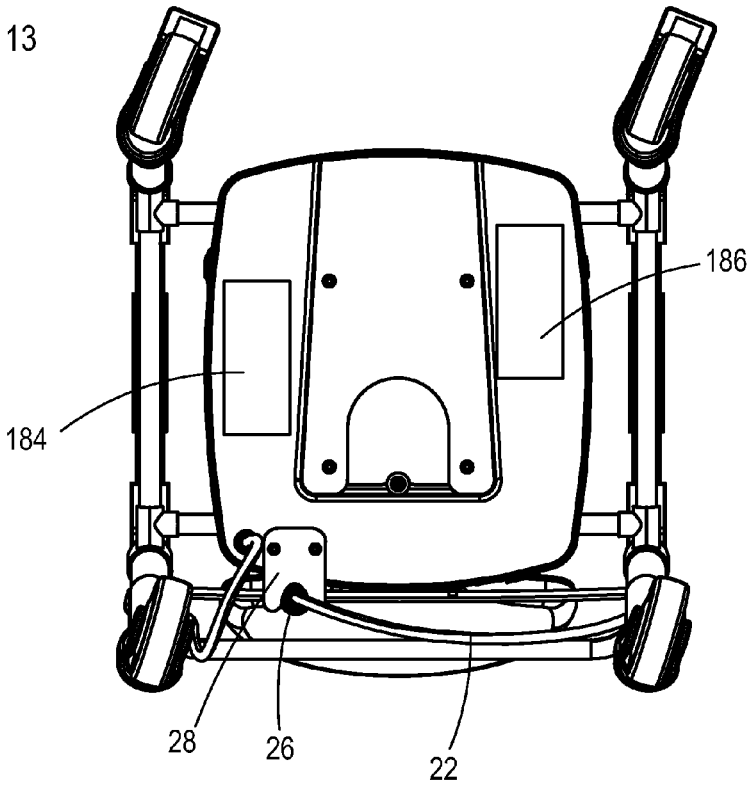
FIG. 13 is a bottom view of the alternative portable toilet showing access doors for servicing an onboard battery charger and an onboard battery.

FIG. 13 is a bottom view of the alternative portable toilet 112 showing access doors 184 and 186 for servicing the onboard battery 170 charger and an onboard battery charger 172, respectively.

Preferably, seat 14, the lid 16, the enclosure 18, and the toilet bowl 20 are formed of plastic. The legs 48, cross bars 36, the support arms 38, the arm rests 32, and the backrest 34 are preferably formed of aluminum tubing.

In operation, an attendant or care giver will preferably place the portable toiler 12 in the lowered position for use. After use, the legs 48 are extended by the care giver. Then, the portable toilet 12 is moved to locate the bowl 20 above a conventional building toilet. The water tube 22 is connected to a sink faucet, preferably using the faucet coupling 26 and water is turned on as the slide door 24 is opened. The contents of the bowl 20 fall from the bowl 20 into the conventional toilet, with water from the spray nozzles 104 swirling around the now 20.

The present invention provides a portable toilet having a bowl with a lower end which will open to spill the contents from the bowl into a conventional building toilet. This allows an attendant or care giver to spill the contents of the bowl without having to touch the contents bowl. Water will then be connected to the bowl and swirl to clean the bowl with waste automatically spilling from the portable toilet into a conventional building toilet.

Although the preferred embodiment has been described in detail, it should be understood that various changes, substitutions and alterations can be made therein without departing from the spirit and scope of the invention as defined by the appended claims.

What is claimed is:

1. A portable toilet having a bowl, a seat disposed on the bowl, and legs which support the bowl and the seat in a upright position, the portable toilet further comprising:

the bowl having an upper end and a lower end, wherein said lower end is defined by at least one section which is moveable relative to said upper end from a closed position, enclosing said lower end of the bowl and retaining contents of the bowl within the bowl, to an open position, exposing said lower end of the bowl for spilling the contents therefrom;

said legs being telescopically extensible to allow positioning of the height of the bowl;

said legs being spaced apart for fitting on opposite sides of a conventional building toilet and placing the bowl above the conventional toilet;

wherein the contents of the bowl fall through the open lower end of the bowl and into the conventional building toilet; and a water supply tube having a first end secured to a faucet coupling, wherein said faucet coupling is configured for removably securing to a water faucet, and said water supply tube having a second end in fluid communication with said bowl such that water from the faucet passes through said water supply tube and into said bowl.

2. The portable toilet according to claim 1, wherein the bowl has an open lower end which is enclosed by a slide door which is moved to open the lower end of the bowl and allow the contents of the bowl to spill therefrom into the conventional toilet.

3. The portable toilet according to claim 1, further comprising pneumatic springs disposed within said legs.

4. The portable toilet according to claim 1, further comprising electric linear actuators disposed in said legs.

5. The portable toilet according to claim 1, and wheels are mounted to the lower ends of the legs.

6. The portable toilet according to claim 1, wherein said seat is pivotally mounted to said bowl.

7. The portable toilet according to claim 1, wherein said bowl is disposed within an enclosure.

8. A portable toilet having a bowl, a seat disposed on the bowl, and legs which support the bowl and the seat in a upright position, the portable toilet further comprising:

the bowl having an upper end and a lower end, said lower end being enclosed by a slide door which is moved to open the lower end of the bowl and allow the contents of the bowl to spill therefrom into the conventional toilet;

said legs being telescopically extensible to allow positioning of the height of the bowl;

said legs being spaced apart for fitting on opposite sides of a conventional building toilet and placing the bowl above the conventional toilet;

wherein said slide door is opened and the contents of the bowl fall through the open lower end of the bowl and into the conventional building toilet; and a water supply tube having a first end secured to a faucet coupling, wherein said faucet coupling is configured for removably securing to a water faucet, and said water supply tube having a second end in fluid communication with said bowl such that water from the faucet passes through said water supply tube and into said bowl.

9. The portable toilet according to claim 8, further comprising pneumatic springs disposed within said legs.

10. The portable toilet according to claim 8, further comprising electric linear actuators disposed in said legs.

11. The portable toilet according to claim 8, and wheels are mounted to the lower ends of legs.

12. The portable toilet according to claim 8, wherein said seat is pivotally mounted to said bowl.

13. The portable toilet according to claim 8, wherein said bowl is disposed within an enclosure, and said slide plate is mounted directly to a lower end of said enclosure.

14. A portable toilet having a bowl, a seat disposed on the bowl, and legs which support the bowl and the seat in a upright position, the portable toilet further comprising:

the bowl having an upper end and a lower end, said lower end being enclosed by a slide door which is moved to open the lower end of the bowl and allow the contents of the bowl to spill therefrom into the conventional toilet;

wherein said bowl is disposed within an enclosure, and said slide plate is mounted directly to a lower end of said enclosure said legs being telescopically extensible to allow positioning of the height of the bowl;

said legs being spaced apart for fitting on opposite sides of a conventional building toilet and placing the bowl above the conventional toilet;

wherein said slide door is opened and the contents of the bowl fall through the open lower end of the bowl and into the conventional building toilet; and a water supply tube having a first end secured to a faucet coupling, wherein said faucet coupling is configured for removably securing to a water faucet, and said water supply tube having a second end in fluid communication with said bowl such that water from the faucet passes through said water supply tube and into said bowl.

15. The portable toilet according to claim 14, further comprising pneumatic springs disposed within said legs.

16. The portable toilet according to claim 14, further comprising electric linear actuators disposed in said legs.

17. The portable toilet according to claim 14, and wheels are mounted to the lower ends of the legs.

18. The portable toilet according to claim 14, wherein said seat is pivotally mounted to said bowl.

* * * * *